US005300195A

United States Patent [19]

Richter et al.

[11] Patent Number: 5,300,195

[45] Date of Patent: Apr. 5, 1994

[54] CONTINUOUS VERTICAL DIGESTER APPARATUS

[75] Inventors: Johan C. F. C. Richter, Oslo, Norway; Ole J. Richter, Karlstad, Sweden

[73] Assignee: Kamyr AB, Karlstad, Sweden

[21] Appl. No.: 200,204

[22] Filed: May 31, 1988

[51] Int. Cl.[5] ..... D21C 7/06; D21C 7/14

[52] U.S. Cl. ..... 162/246; 162/251

[58] Field of Search ..... 162/237, 17, 18, 19, 162/68, 251, 51, 52, 246

[56] References Cited

U.S. PATENT DOCUMENTS

| | | | |
|---|---|---|---|
| 2,858,211 | 10/1958 | Durant et al. | 162/237 |
| 3,471,366 | 10/1969 | Reinhall | 162/19 |
| 3,530,034 | 9/1970 | Erikson | 162/62 |
| 3,743,572 | 7/1973 | Richter . | |
| 3,843,468 | 10/1974 | Laakso | 162/237 |
| 3,849,247 | 11/1974 | Richter | 162/237 |
| 3,963,561 | 6/1976 | Richter . | |
| 4,093,511 | 6/1978 | Richter | 162/237 |
| 4,637,878 | 1/1987 | Richter et al. . | |

FOREIGN PATENT DOCUMENTS 974341 11/1964 United Kingdom .

OTHER PUBLICATIONS

Kamyr Pulp Equipment publication; Feb., 1972; pp. 8 through 43; Illustration of conventional prior art digesters, pp. 1 through 5.

*Primary Examiner*—Steve Alvo

*Attorney, Agent, or Firm*—Cushman, Darby & Cushman

[57] ABSTRACT

In the continuous cooking of comminuted cellulosic fibrous material (e.g. wood chips) to produce paper pulp, the material is subjected to a minimum of mechanical action, especially under high temperature and pressure conditions, so as to increase the quality of the pulp. Also, even for large digesters the uniformity of treatment is enhanced, and scaling may be reduced while energy efficiency is increased. Material is fed without significant steaming to a feeder screw within a perforated cylinder mounted at the bottom of an impregnation vessel. The material flows upwardly in the impregnation vessel, with screens adjacent the top of the vessel thickening the slurry before it is discharged into the top of a continuous digester. The discharge from the impregnation vessel to the continuous digester is made with a minimum of mechanical action on the pulp. The impregnation vessel may be disposed within, and concentric with, the digester, or it may located exteriorly of the digester and supply more than one digester. Conduits mounted on the exterior of the impregnation vessel, when concentric with the digester, can supply treatment liquid at various locations along the height of the digester.

20 Claims, 4 Drawing Sheets

258
260
H.P. STEAM
262
237
89'
89
263
250'
246
NO. 2
264
NO. 1
251
88
LIQUOR
27
247
250
235
28
18
23
16
38'
239
H.P. STEAM
29
255
272
LIQUOR
273
PULP OUT

CONTINUOUS VERTICAL DIGESTER APPARATUS

BACKGROUND AND SUMMARY OF THE INVENTION

In the production of paper pulp from comminuted cellulosic fibrous material, such as wood chips, by using a continuous digester, it has been found that the quality of the chemical pulp produced is significantly affected by how much mechanical action the chips are subjected to during the treatment process. Mechanical handling of, and mechanical action on, the chips damages them, and reduces their size. This is especially so when high temperature or pressure conditions exist, or chemicals are present, as the chips are being acted upon by a mechanical device. For example, a conveying screw that slants at 30° to the horizontal, and such as utilized conventionally at the top of some vapor phase/liquid phase digesters, increases the amount of pinchips (which is an indicator of material damage) greater than 1.4%, while a horizontal conveying screw (if there is no significant adverse pressure or temperature condition) would increase the number of pinchips by less than 0.4%. This increase in damage to the material is just a visible increase in damage, and in fact there is additional damage to the chips that is not readily noticeable.

In the production of chemical pulp from continuous digesters, the trend——since the beginning of continuous cooking——has been toward larger and larger vessels. As a matter of fact, the size of some conventional digesters has increased to the point where uniform treatment is extremely difficult to achieve. This is so since every time the digester diameter is doubled, the distance for displacement of liquid is doubled, the cross-sectional area is quadrupled, and the volume is increased 8 times. This has resulted in the utilization of "cheater flows" in some large digesters, and even with "cheater flows" desired results are not necessarily achieved since the wash efficiency is significantly decreased and quality and yield may still be unacceptable.

The most common conventional digester systems utilized are the hydraulic digester, steam phase digester, two vessel steam phase digester, two vessel hydraulic digester, and two vessel hydraulic with modified continuous cooking. All of these systems are subject to the quality problems mentioned above, and are limited by the size difficulties also discussed above. While the hydraulic digester often has good heat economy and minimizes damage to the chips since it has just one top separator and a cold blow (which neutralizes the damaging effect of the digester outlet), it is sensitive to poor furnish which provokes "hang-ups", heater flow is less than desirable, and the dependability and quality are questionable past a capacity of 1,000 tons per day.

Conventional steam phase digesters are typically easy to operate, and less dependent on furnish hang-ups than hydraulic digesters, but there is reduced heat economy due to the use of direct steam, and there can be quality problems associated with the way that the chips are steamed in a conventional horizontal steaming vessel, and there is a risk of hammering. The two vessel steam please digester systems reduce tailings and therefore increases the uniformity of the product, and possibly improves the heat balance, but does so at a loss of strength and quality since the chips are subjected to more mechanical action. Two vessel hydraulic systems have advantages over conventional hydraulic digesters, however heating is effected by mixing rather than displacement so that the chips are heated to about 4°-7° C. above the final cooking temperature, resulting in increased pressure, and undesirable action on the chips, and undesirable complications for the system. Two vessel hydraulic systems with modified continuous cooking allow the production to be increased so that 1,500 tons per day capacity is not unusual, however when the chips are mechanically acted upon this often is in the presence of white liquor, or higher concentrations of white liquor than in other systems, resulting in increased chip degradation.

According to the present invention, a continuous cooking apparatus and method are provided that address the quality drawbacks, size limitations, and energy efficiency problems that are inherent in modern continuous systems. According to the present invention, quality is enhanced by reducing the mechanical action on the chips, especially under temperature, pressure, and consistency conditions which result in the most severe degradation. Quality is further addressed by enhancing the uniformity of the treatment. Size limitations are also addressed in some embodiments by effectively minimizing the displacement distances. Energy efficiency is also dealt with by minimizing heat loss. The desirable results achievable according to the present invention can be achieved in a relatively simple manner, with only minor changes to existing configurations, utilizing only conventional components, and at a reasonable price.

According to one aspect of the present invention, an apparatus for the continuous cooking of wood chips to produce paper pulp is provided which includes a generally vertically disposed impregnation vessel having a top and a bottom, and a generally vertically disposed digester having a top and a bottom with an inlet at the top. Means are provided for feeding a liquid slurry of wood chips to the bottom of the impregnation vessel, and at the bottom of the impregnation vessel a mechanical separating means for separating the chips from some of the liquid (so as to decrease the liquid to material ratio of the slurry) is provided. Such mechanical separating means preferably takes the form of a feeder screw rotatable in a perforated cylinder (i.e. a conventional "top separator"). The top of the impregnation vessel is adjacent the top of the digester, and means are provided for transferring the material from the top of the impregnation vessel to the top of the digesting vessel with a minimum of mechanical action on the material. Typically, a small rotating distributor will be provided, but it is also possible to effect transfer utilizing only means for establishing fluid flows. Extraction screens are disposed in the digester, which may be "live" screens, and the pulp is discharged from the bottom of the digester, as is conventional.

According to the preferred embodiment, the impregnation vessel is located within, and generally concentric with, the digester. Not only does this increase pulp quality by providing the bulk of the mechanical action on the chips when they are the coolest, under the least pressure, and at a relatively high liquor to material ratio, but it addresses the size and energy efficiency problems at the same time. By locating the impregnation vessel within the digester, energy efficiency is enhanced, and also smaller volumes for displacement are provided since the material moving in the digester moves in a ring shape, the center of the digester being occupied by the impregnation vessel. Treatment liquid (typically white liquor) is added in the digester at various points along its length by conduits which are attached to the exterior of the impregnation vessel, and terminate at different heights along its length, uniformly adding the liquor at those points. The apparatus may comprise either a steam digester or an hydraulic digester; in the former, high pressure steam is preferably added at the top of the digester, and there is no need to use a conventional horizontal steaming vessel prior to the impregnation vessel.

The impregnation vessel also may be separate from the digester, and it may be insulated (e.g. double walled) in order to improve energy efficiency.

According to the present invention there also is provided a method of continuously digesting comminuted cellulosic fibrous material to produce paper pulp by practicing——substantially sequentially and continuously——the following steps: (a) Feeding a liquid slurry of comminuted cellulosic fibrous material at a liquid to material ratio of about 20–25/1 to the bottom of the impregnation vessel. (b) Separating some of the liquid from the slurry at the bottom of the impregnation vessel to provide a liquid to material ratio in the impregnation vessel of about 5–8/1. (c) Impregnating the material with liquid as it flows upwardly in the impregnation vessel from the bottom to the top thereof. (d) Moving the material from the top of the impregnation vessel to the top of the digesting vessel with a minimum of mechanical action on the material. (e) Digesting the material in the digesting vessel, utilizing digesting liquid, at a liquid to material ratio of about 3–5/1; and (f) withdrawing pulp from the bottom of the digesting vessel. The typical residence time in the impregnation vessel is about 20 to 30 minutes.

The invention also contemplates a system, in general, for pulp treatment. According to this aspect of the invention there is provided: A first generally vertically disposed impregnation vessel having a top and a bottom. A second generally vertically disposed vessel having a top and a bottom. The tops of the two vessels being located adjacent each other, and interconnected so that slurry may flow from one to the other, with the first vessel located within, and generally concentric with, the second vessel. A liquid/material separating means located at the bottom of the first vessel, comprising a feeder screw mounted within a perforated screen cylinder, and rotatable with respect to the cylinder; and, screen means located adjacent the top of the first vessel for removing some liquid from the slurry at the top of the first vessel.

It is the primary object of the present invention to enhance the quality of chemical pulps produced by continuous digestion. This and other objects of the invention will become clear from the detailed description of the invention, and from the appended claims.

DETAILED DESCRIPTION OF THE DRAWINGS

Figures 1, 2:
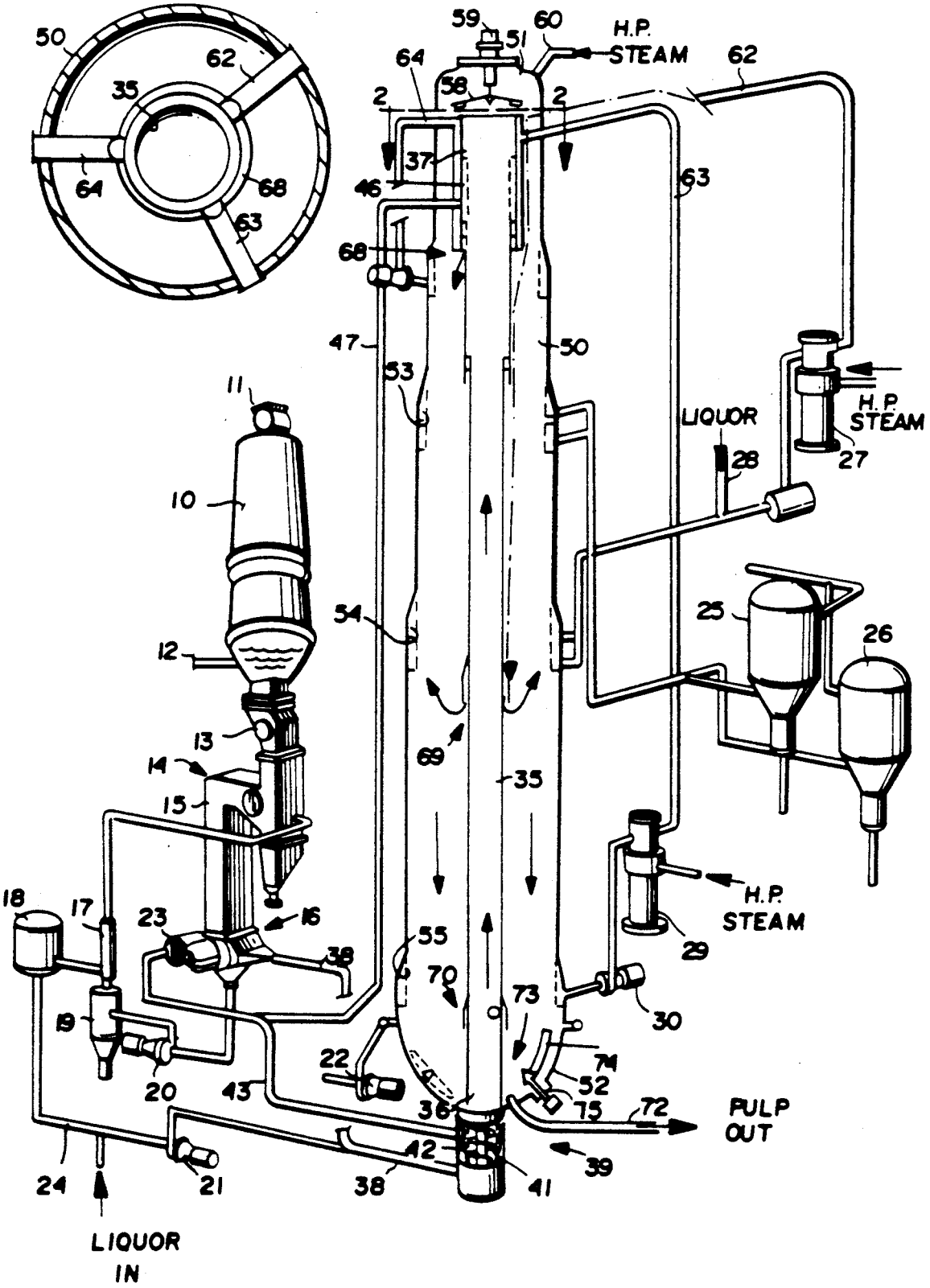
FIG. 1 is a side schematic view, partly in cross-section and partly in elevation, of an exemplary digester system according to the present invention.
FIG. 2 is a schematic cross-sectional view taken along lines 2—2 of FIG. 1.

Most of the components of the apparatus illustrated in FIGS. 1 through 5 are conventional in continuous digester systems. For example a chips bin 10 (preferably the vibratory type) having an air lock 11 at the top thereof has connections 12 for bin steaming by flash steam from flash tanks 25, 26, and leads to a chip meter 13, and past tramp material separator 14 into a chip chute 15 connected to the high pressure feeder 16. Those components are variously connected to an in-line drainer 17, a level tank 18, a sand separator 19, and various other pipes and components, such as pumps 20, 21, 22, and 23, and to the conduit 24 to which white liquor is added. Other conventional components include the flash tanks 25 and 26; heater 27 supplied with high pressure steam; white liquor input conduit 28; wash heater 29 supplied with high pressure steam; and a pump 30.

According to the present invention, for the embodiment illustrated in FIG. 1, a generally vertically disposed impregnation vessel 35 is provided having a bottom 36, and a top 37. Means are provided, including the conduit 38 connected to the high pressure feeder 16, and all the other conventional apparatus illustrated, for feeding a liquid slurry of comminuted cellulosic fibrous material (wood chips) to the bottom of the vessel 36. A mechanical separating means, shown generally by reference numeral 39, is provided at the bottom of the impregnation vessel 35. This mechanical separating means separates the material from the liquid, so as to decrease the liquid/material ratio. Typically the liquid/material ratio in the conduit 38 is about 20–25/1, and that is reduced to about 5–8/1 in the impregnation vessel 35 (by the mechanical separator 39).

The mechanical separator 39 preferably has a construction of a conventional "top separator", which is typically provided at the top of conventional continuous digesters. That is, it includes a feeder screw 41 or the like rotatable by a conventional motor (not shown) and disposed within a concentric perforated cylinder 42. The open screen areas in the cylinder 42 are large enough to allow liquid to be extracted therefrom by the pump 23, through the conduit 43, but small enough so that most of the wood chips or like material cannot pass therethrough.

The provision of the mechanical separator 39 at the position illustrated in FIG. 1 is greatly advantageous compared to locating essentially the same device at the top of a conventional continuous digester. It is advantageous since the degrading effect that it has on the wood chips is much less at the position illustrated in FIG. 1. This is so since the liquid to wood ratio at that point is much higher than at the top of the digester (where it is about 3–5/1), the temperature is not as high, and there is a lower concentration of chemicals (e.g. white liquor).

Adjacent the top 37 of the impregnation vessel 35 extraction screens 46 are provided, connected to conduit 47 leading to pump 23. These conventional extraction screens 46 decrease the liquid to wood ratio from about 5–8/1 (the conditions in the impregnation vessel 35) to about 3–5/1 (the conditions desirable for digestion).

The apparatus according to the invention also comprises a second, or digesting vessel 50. This vessel is also generally vertical, having a top 51 and a bottom 52.

Disposed at various points along the length thereof, in the interior thereof, are extraction screens 53, 54, 55, and the like. While these extraction screens may be conventional stationary screens, preferably they are "live" screens such as shown in U.S. Pat. No. 4,637,878 (the disclosure of which is hereby incorporated by reference herein). Note that the top 51 of the digester 50 is at approximately the same level as, and adjacent, the top 37 of the impregnation vessel 35.

Means are provided for transferring the material from the top 37 of the impregnation vessel to the top 51 of the digesting vessel with a minimum of mechanical action on the material. In FIG. 1, this is accomplished utilizing the light rotating distributor 58, rotated by motor 59, which provides very little mechanical action on the material, but rather just evenly distributes it as it overflows from the top of the impregnation vessel 35 into the digester 50.

The system of FIG. 1 is a steam phase digester system. High pressure steam is added through conduit 60 at the top of the digester 50. Note that aside from a small amount of bin steaming provided by conduits 12, there is no steaming of the chips before they are fed to the separator means 39——i.e. the conventional horizontal steaming vessel utilized in prior art steam phase digester systems is eliminated.

As clearly evident in FIGS. 1 and 2, the embodiment therein provides the impregnation vessel 35 within the digester 50, located essentially concentrically therein. The impregnation vessel 35 typically is welded at its bottom 36 to the bottom 52 of the digester 50, and at the top it is positively positioned by the pipes 62, 63, and 64. Such an arrangement not only achieves the desired goal of minimum of mechanical action on the chips, especially under adverse conditions, but also decreases the flow distance of liquids within the digester 50, and increases energy efficiency. Since the impregnation vessel 35 is within the digester 50, there will be almost no heat loss from it, and in fact the chips will gain heat as they move upwardly therewithin. Since the vessel 35 occupies a great deal of the interior of the vessel 50, the pulp column in the vessel 50 is annular, and this reduces the maximum actual flow distance for displacement of any liquids during digestion or washing in the vessel 50, for a given tonnage.

Typically, the impregnation vessel 35 has a slightly smaller interior (and exterior) diameter at the bottom 36 thereof than at the top 37 thereof so as to facilitate even and uniform flow of the slurry upwardly in the vessel 35, and its average diameter is about 2 meters. A typical residence time of material, during impregnation in the vessel 35, is about 20–30 minutes. The digester 50, as is conventional, has a smaller effective cross-sectional area at the top thereof than at the bottom thereof, not only because the impregnation vessel 35 is larger at its top than at its bottom, but also because the digester 50 increases in size itself from the top to the bottom, again to facilitate uniform and smooth flow of the material in the column therewithin.

The vessel 35 provides a convenient structure to assist in the introduction of white liquor, and like treatment liquors, into the digester 50. The conduits 62, 63, and 64, which are welded at their introduction into the digester 50 and to the vessel 35, not only support the top of the vessel 35, but conduct the treatment liquids. Each conduit extends down along the length of the vessel 35 a different amount. For example the conduit 64 extends up to about the point 68 and then terminates. The conduit 62 extends downwardly up to about the point 69 and then terminates, while the conduit 63 extends down along the exterior of the vessel 35 to about the point 70 and then terminates. At each termination 68, 69, 70 there preferably is provided an annular distribution device (which devices are illustrated only schematically in the drawings), which evenly distributes the treatment liquid added by the conduit along the entire exterior periphery of the vessel 35, to be displaced outwardly uniformly throughout the chips column in the digester 50.

At the bottom 52 of the digester 50, a pulp discharge means is provided. This includes the conduit 72 which is adjacent the impregnation vessel 35, and also one or more pulp discharge devices. One such discharge device is illustrated generally by reference numeral 73 in FIG. 1, and includes at least one arm 74 which is pivoted by powered shaft 75. In the embodiment actually illustrated in FIG. 1, the arm 74 comprises a wiper arm which is oscillated back and forth by the rotatable shaft 75; however it could also comprise a conventional small rotatable discharge head having a plurality of blades (such as illustrated at 173 in FIG. 3).

Figure 3:
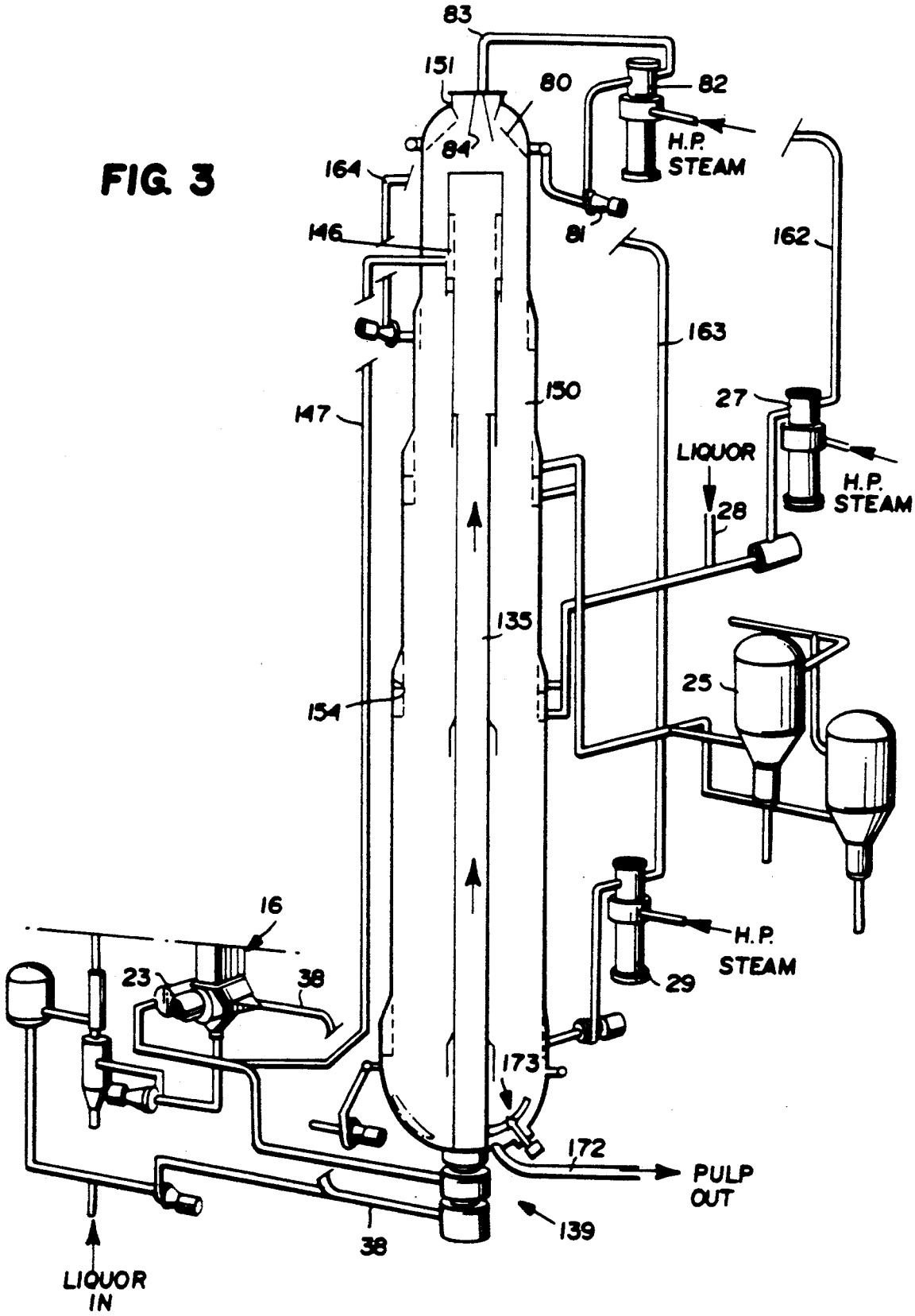
FIGS. 3 through 5 are schematic views like those of FIG. 1, but showing different exemplary embodiments of the apparatus according to the invention.

In the FIG. 3 embodiment, the same accessory conventional components as in the FIGS. 1 and 2 embodiment are illustrated by the same reference numerals as in the FIGS. 1 and 2 embodiment, while the modified structures as according to the invention are illustrated by the same reference numeral only preceded by a "1". This embodiment is essentially the same as the FIG. 1 embodiment, comprising a concentric interiorly located impregnation vessel 135 in a digester 150, except that it utilizes a hydraulic digester 150. At the top 151 of the digester 150, screen means 80 are provided operatively connected to a pump 81, which circulates extracted liquor from the top of the hydraulically filled digester 150 through a heater 82 (supplied with high pressure steam), which liquid is circulated back through conduit 83 to be introduced into the top 84 of the vessel. The liquid flows established by the screen 80 (which extends around the entire interior periphery of the top 151 of the digester 150) results in uniform transfer of the material from the interior of impregnation vessel 135 to the digester 150, without mechanical action on the chips. The conduits 162, 163, 164, are connected as in the FIGS. 1 and 2 embodiment, but are not shown in FIG. 3 for simplicity of illustration.

In FIG. 4, again conventional components comparable to those illustrated in the FIGS. 1 and 2 embodiment are indicated by the same reference numeral, while inventive components similar in function to those in the FIG. 1 embodiment are shown by the same reference numeral only preceded by a "2".

Figure 4:
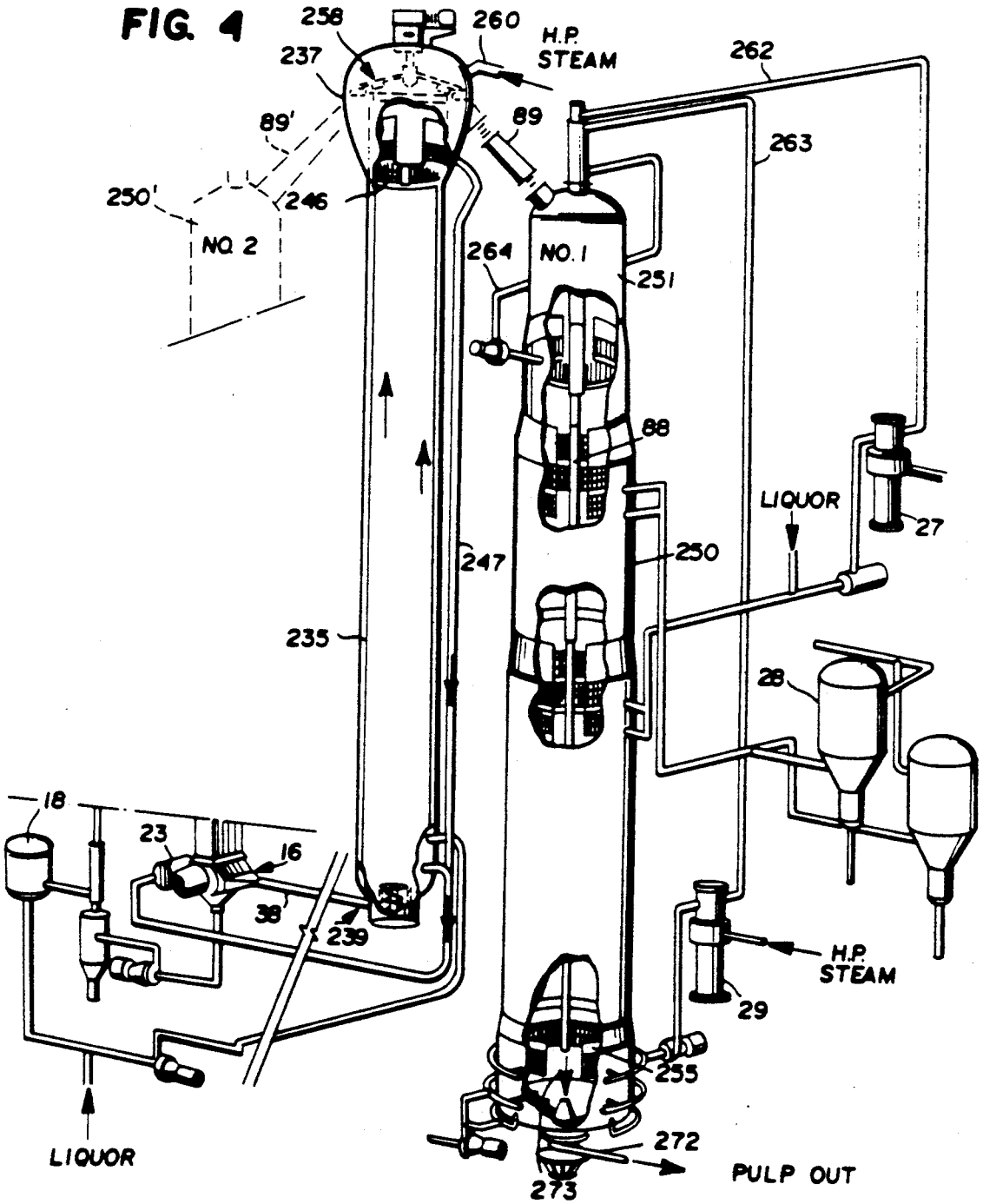

In the FIG. 4 embodiment, the impregnation vessel 235 is separate from the digester 250. The impregnation vessel 235 may be insulated, for example by being double walled (as illustrated), in order to conserve heat. A second continuous digester 250' may also be provided (or even more where possible), so that the single impregnation vessel 235 supplies a number of digesters. The extraction screens 246 are disposed in the enlarged top portion 237 of the vessel 235, with the light duty distributor 258 evenly distributing the material that is discharged into a conventional launder inside the enlarged top 235 to flow through conduits 89, 89' respectively into the digesters 250, 250'.

In the FIG. 4 embodiment, note that the treatment liquids are added in the interior of the digester 250 utilizing the central pipe 88 (which is connected to the conduits 262, 263, 264), which conduit 88 is conventional in existing digesters. Also, since there is no concentric impregnation vessel in this embodiment, a centrally located discharge scraper 273 is provided, above the centrally located pulp discharge 272. High pressure steam is added at 260 to steam and heat the material as it is being discharged to the digesters 250, 250'.

Figure 5:
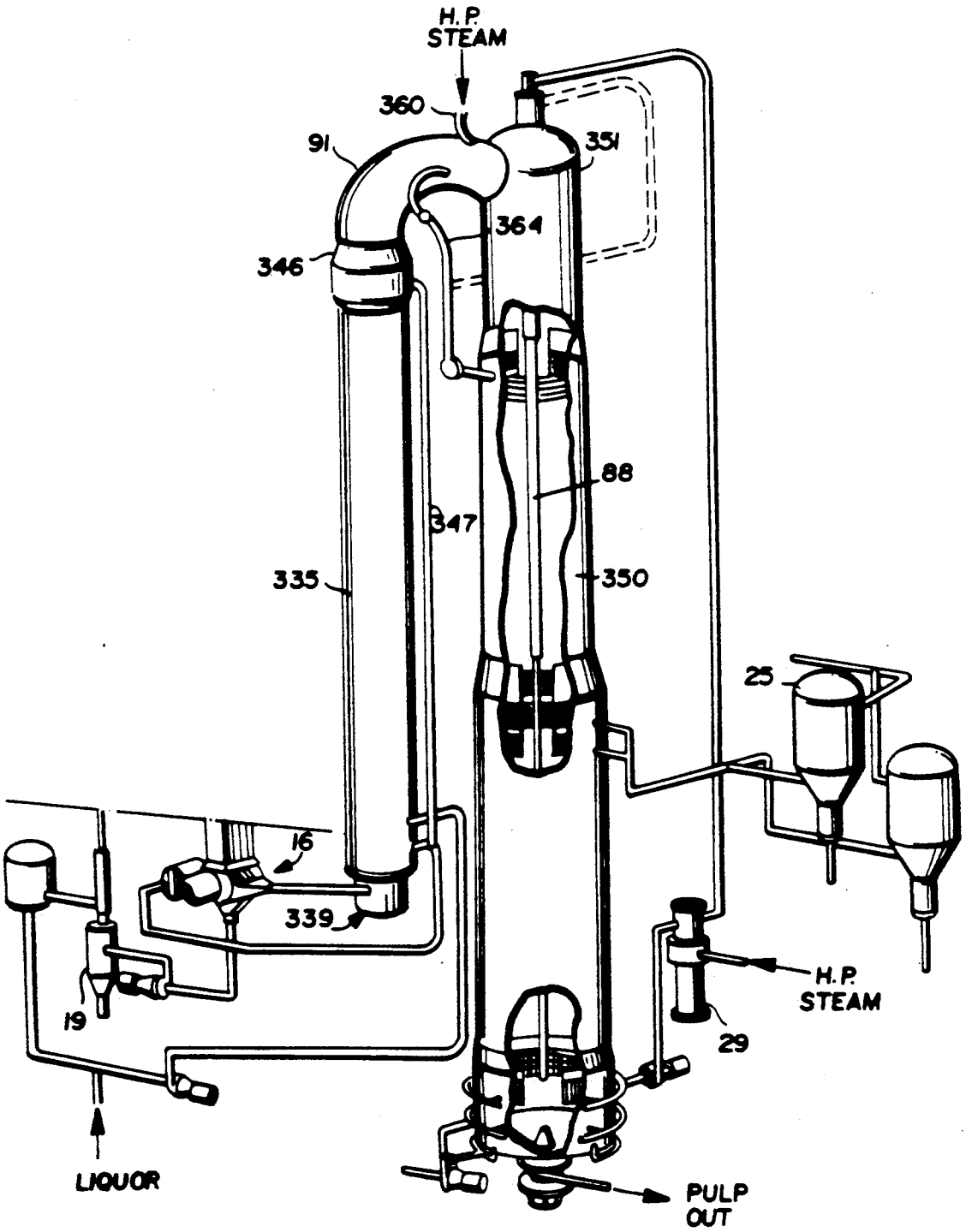

In the FIG. 5 embodiment, conventional structures comparable to those in the FIG. 1 embodiment are illustrated by the same reference numeral, and modified structures according to the invention that have basically the same function as those in the FIG. 1 embodiment are illustrated by the same reference numeral only preceded by a "3". In this embodiment, as in the FIG. 4 embodiment, the impregnation vessel 335 is distinct from the digester 350, only this embodiment utilizes a conventional hydraulic digester 350, instead of the steam digester 250 of the FIG. 4 embodiment. In this embodiment a curved conduit 91 is provided at the top of the impregnator 335, above the screens 346. No mechanical transfer device is provided, but rather transfer of the material from the impregnation vessel 335 to the top 351 of the digester 350 is facilitated by entraining the material in fluid flows, provided by high pressure steam introduced in conduit 360, and recirculated liquid from digester 350 introduced into the curved conduit portion 91. The points of introduction of the fluids at the conduits 360, 364 into the conduit 91 are such that the fluid flow is directed toward the top 351 of the digester 350, which tends to entrain the material in its flow and move it into the digester 350 without mechanical action on the material. The recirculated liquor in conduit 364 preferably passes through a heater and is indirectly heated.

Method

According to the invention, a method of continuously digesting comminuted cellulosic fibrous material to produce high quality pulp is provided, by substantially sequentially and continuously: (a) Feeding a liquid slurry of comminuted cellulosic fibrous material at a liquid to material ratio of about 20–25/1 to the bottom 36 of an impregnation vessel 35. (b) Separating some of the liquid from the slurry at the bottom of the impregnation vessel (e.g. utilizing separator 39) to provide a liquid to material ratio in the impregnation vessel 35 of about 5–8/1. (c) Impregnating the material with liquid as it flows upwardly in the vessel 35 from the bottom 36 to the top 37 thereof. (d) Moving the material from the top 37 of the vessel 35 to the top 51 of the digester 50 with a minimum of mechanical action on the material (e.g. with light duty scraper 58, or entraining fluid flows provided by screens 80 and pump 81. (FIG. 3), or conduits 360, 364 (FIG. 5)). The liquid to material ratio is typically reduced at the top of the impregnation vessel 35 (as by utilizing screens 46) so that it is about 3–5/1. (e) Digesting the material in the digester 50, utilizing digesting liquid (and typically washing or otherwise treating the material in the vessel 50, too) at a liquid to material ratio of about 3–5/1; and (f) withdrawing pulp from the bottom conduit 72 of the digester 50. The digesting or other treatment liquid may be supplied from the exterior of the impregnation vessel 35 (where it is concentric with the digester 50) so that it moves uniformly outwardly around the exterior periphery of the vessel 35, into the flow of material in the digester 50, at spaced points along the height of the vessel 35.

It will thus be seen that according to the present invention high quality chemical pulp may be produced in a continuous cooking process. Quality is enhanced by providing a minimum amount of mechanical action on the material, and typically only where the liquid/-material ratios, temperature, and/or pressure conditions are favorable, and by providing uniform treatment. Also, the effects of increasing size on the uniformity of treatment are minimized by providing the impregnation vessel concentrically within the digester. Scaling is reduced because of the introduction of high pressure steam at the tops of the digesting vessels. Also energy efficiency is enhanced.

While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent structures and methods.

What is claimed is:

1. Apparatus for continuous cooking of cellulosic fibrous material to produce paper pulp, comprising:

(a) a generally vertically disposed elongated impregnation vessel without a vertical screw so as to minimize mechanical action on the cellulosic fibrous material having a top and a bottom, and solid side walls;

(b) means for feeding a liquid slurry of cellulosic fibrous material to the bottom of the impregnation vessel;

(c) a mechanical separating means disposed at the bottom of the impregnation vessel for separating cellulosic fibrous material from liquid, so as to decrease the liquid to material ratio of the slurry;

(d) a generally vertically disposed digesting vessel having a top and a bottom, and an inlet at the top thereof;

(e) the top of the impregnation vessel located adjacent the top of the digesting vessel;

(f) means for transferring the material from the top of the impregnation vessel to the top of the digesting vessel with a minimum of mechanical action on the material;

(g) the length of the path of movement in the impregnation vessel from means (c) to (f) is about equal to the height of the digesting vessel;

(h) extraction screen means disposed in the digesting vessel for withdrawing liquid therefrom; and (i) pulp discharge means disposed adjacent the bottom of the digesting vessel and wherein the impregnation vessel is disposed within said digesting vessel, generally concentric therewith and conduit means being provided and disposed on the exterior of the impregnation vessel for distributing treatment liquid into the column of material in the digesting vessel at a plurality of different levels within the digesting vessel.

2. Apparatus as recited in claim 1 wherein said means (b) is devoid of steaming means; and further comprising means for steaming the material at approximately the time of transfer of the material from the impregnation vessel to the digesting vessel.

3. Apparatus as recited in claim 1 wherein a pair of digesting vessels are provided, and wherein said means (f) comprises means for transferring material from the impregnation vessel to the tops of both of the digesting vessels.

4. Apparatus as recited claim 1 wherein the impregnation vessel is substantially circular in cross-section, and said conduit means comprises three distinct conduits spaced arcuately from each other on the exterior of the impregnation vessel, each conduit extending from adjacent the top of the impregnation vessel to a different height along the length of the impregnation vessel; and further comprising a generally annular distributor located at the termination of each conduit, to supply liquid evenly around the impregnation vessel at that point.

5. Apparatus as recited in claim 1 wherein the impregnation vessel has a smaller effective cross-sectional interior area at the bottom thereof than at the top thereof, so as to facilitate continuous and even flow of the material from the bottom to the top of the impregnation vessel.

6. Apparatus as recited in claim 5 wherein the digesting vessel has a smaller effective cross-sectional interior area at the top thereof than at the bottom thereof, so as to facilitate continuous and even flow of the material from the top to the bottom of digesting vessel.

7. Apparatus as recited in claim 1 wherein said means (i) comprises at least one wiper arm located at the bottom of the digesting vessel, and pivotally movable to effect discharge of the pulp through an outlet adjacent the bottom of the impregnation vessel.

8. Apparatus as recited in claim 1 wherein the impregnation vessel is distinct from, and located exteriorly of, the digester vessel.

9. Apparatus as recited in claim 8 wherein the impregnation vessel includes insulation means to prevent heat loss therefrom.

10. Apparatus as recited in claim 9 wherein the impregnation vessel is double-walled.

11. Apparatus as recited in claim 8 wherein the means (f) comprises no mechanical elements, but rather comprises means for establishing fluid flows which assist in transporting the material from the impregnation vessel to the digesting vessel.

12. Apparatus as recited in claim 11 wherein said means for establishing fluid flows includes means for steaming the material as it is being transferred from the impregnation vessel to the digesting vessel.

13. Apparatus as recited in claim 1 further comprising means disposed in said impregnation vessel for decreasing the liquid to material ratio of the slurry just prior to the means (f).

14. Apparatus as recited in claim 1 wherein said means (c) comprises a rotating feeder screw disposed within a perforated tubular separating shell having perforations therein large enough to allow liquid flow therethrough, but small enough to prevent most material flow therethrough.

15. Apparatus as recited in claim 1 wherein the digesting vessel comprises a steam phase digester.

16. Apparatus as recited in claim 1 wherein the digesting vessel comprises a hydraulic digester.

17. Apparatus as recited in claim 1 further comprising extraction screens disposed along the length of the digesting vessel.

18. Slurry treating apparatus comprising a first elongated generally vertically disposed impregnation vessel without a vertical screw so as to minimize mechanical action on cellulosic fibrous material having a top and a bottom, and solid side walls;

a second generally vertically disposed vessel having a top and a bottom;

the tops of the two vessels being located adjacent each other, and interconnected so that slurry may flow from one to the other, with the first vessel located within, and generally concentric with, the second vessel, and the bottoms of the vessels being located adjacent each other;

a liquid/material separating means located at the bottom of the first vessel, comprising a feeder screw mounted within a perforated screen cylinder, and rotatable with respect to the cylinder; and screen means located adjacent the top of the first vessel for removing some liquid from the slurry at the top of the first vessel, a plurality of conduits being disposed on the exterior of the first vessel, and extending downwardly from adjacent the top of the first vessel toward the bottom thereof, the conduits terminating at a plurality of different heights with the second vessel.

19. Apparatus as recited in claim 18 wherein the first vessel has a smaller interior cross-sectional area at the bottom thereof than at the top thereof, and the second vessel has a smaller interior cross-sectional area at the top thereof than at the bottom thereof.

20. Apparatus for continuous cooking of cellulosic fibrous material to produce paper pulp, comprising:

(a) a generally vertically disposed impregnation vessel having a top and a bottom;

(b) means for feeding a liquid slurry of cellulosic fibrous material to the bottom of the impregnation vessel;

(c) a mechanical separating means disposed at the bottom of the impregnation vessel for separating cellulosic fibrous material from liquid, so as to decrease the liquid to material ratio of the slurry;

(d) a generally vertically disposed digesting vessel having a top and a bottom, and an inlet at the top thereof;

(e) the top of the impregnation vessel located adjacent the top of the digesting vessel, and disposed concentrically with the digesting vessel;

(f) means for transferring the material from the top of the impregnation vessel to the top of the digesting vessel with a minimum of mechanical action on the material;

(g) extraction screen means disposed in the digesting vessel for withdrawing liquid therefrom;

(h) pulp discharge means disposed adjacent the bottom of the digesting vessel;

(i) conduit means disposed on the exterior of the impregnation vessel for distributing treatment liquid into the column of material in the digesting vessel at a plurality of different levels within the digesting vessel;

(j) said impregnation vessel being substantially circular in cross-section, and said conduit means comprising three distinct conduits spaced arcuately from each other on the exterior of the impregnation vessel, each conduit extending from adjacent the top of the impregnation vessel to a different height along the length of the impregnation vessel; and (k) a generally annular distributor located at the termination of each conduit, to supply liquid evenly around the impregnation vessel at that point.

* * * * *